US011124947B2

(12) United States Patent
Miller

(10) Patent No.: US 11,124,947 B2
(45) Date of Patent: Sep. 21, 2021

(54) CONTROL SYSTEM FOR A WORK MACHINE

(71) Applicant: Deere & Company, Moline, IL (US)

(72) Inventor: Gordon E. Miller, Dubuque, IA (US)

(73) Assignee: Deere & Company, Moline, IL (US)

( * ) Notice: Subject to any disclaimer, the term of this patent is extended or adjusted under 35 U.S.C. 154(b) by 229 days.

(21) Appl. No.: 16/108,251

(22) Filed: Aug. 22, 2018

(65) Prior Publication Data

US 2020/0063399 A1 Feb. 27, 2020

(51) Int. Cl.

| | |
|---|---|
| ***E02F 3/00*** | (2006.01) |
| ***E02F 9/20*** | (2006.01) |
| ***E02F 3/43*** | (2006.01) |
| ***E02F 9/26*** | (2006.01) |
| *E02F 3/34* | (2006.01) |

(52) U.S. Cl.

CPC ..... *E02F 9/2029* (2013.01); *E02F 3/434* (2013.01); *E02F 3/437* (2013.01); *E02F 9/264* (2013.01); *E02F 3/3405* (2013.01)

(58) Field of Classification Search

USPC ..... 701/50

See application file for complete search history.

(56) References Cited

U.S. PATENT DOCUMENTS

| | | | | |
|---|---|---|---|---|
| 7,483,808 | B2 | 1/2009 | Greiner et al. | |
| 7,555,855 | B2 | 7/2009 | Alshaer et al. | |
| 7,669,354 | B2 | 3/2010 | Aebischer et al. | |
| 8,825,314 | B2 | 9/2014 | Jensen | |
| 9,511,633 | B2 * | 12/2016 | Anderson | B60C 23/002 |
| 9,573,583 | B2 | 2/2017 | Rindfleisch et al. | |
| 2005/0149245 | A1 | 7/2005 | Kilworth et al. | |
| 2008/0219820 | A1 | 9/2008 | Kiegerl et al. | |
| 2013/0346127 | A1 * | 12/2013 | Jensen | G06Q 10/06 705/7.12 |
| 2015/0197239 | A1 | 7/2015 | Vilar et al. | |
| 2017/0226717 | A1 * | 8/2017 | Cherney | E02F 9/2029 |
| 2018/0239849 | A1 * | 8/2018 | Martinsson | G06K 9/00214 |
| 2018/0347154 | A1 * | 12/2018 | Martinsson | E02F 3/431 |

* cited by examiner

*Primary Examiner* — James M McPherson

(57) ABSTRACT

A sensor-augmented system for optimizing the loading parameters of a work machine to engage a pile. The system comprises a sensor coupled with the work machine where the sensor is configured to collect image data of the pile in a field of view of the sensor; a sensor processing unit communicatively coupled with the sensor where the sensor processing unit is configured to calculate a volume estimation of the pile based on the image data; and a vehicle control unit communicatively coupled with the sensor processing unit to modify a loading parameter of the work machine in response to a calculated predictive load based on the volume estimation and stored data to identify material type of the pile.

11 Claims, 5 Drawing Sheets

CONTROL SYSTEM FOR A WORK MACHINE

CROSS-REFERENCE TO RELATED APPLICATIONS

N/A

FIELD OF THE DISCLOSURE

The present disclosure relates to a control system for a work machine having an attachment, wherein the attachment is movably coupled to the work machine.

BACKGROUND

The present disclosure relates to a control system and method for facilitating the efficient operation of a work machine during loading operations. Loading operations generally include loading, carrying, and unloading a pile. A pile may include material such as dirt, sand, quarry rocks, and prefabricated man-made materials, etc. Optimizing operation of the subsystems of a work machine is contingent upon the operator's effectiveness and experience with engaging a pile. For example, if the work machine is moving in a fuel economy mode and suddenly engages with a pile, the machine may stall because the engine and transmission may not react quickly enough to overcome the sudden increase in load. Alternatively, if the operator overcompensates for an anticipated load through manual input, this can lead to excessive fuel consumption and increased tire wear.

SUMMARY

Accordingly, the present disclosure includes a system for optimizing the loading parameters of a work machine with a sensor-augmented guidance system to address inefficiencies of the machine when engaging with a pile. The work machine, extending in a fore-aft direction, has a frame configured to support an engine, a transmission, a hydraulic cylinder, an engine speed sensor, and an attachment movably coupled to the work machine to engage a pile.

According to an aspect of the present disclosure, the sensor-augmented guidance system for optimizing the loading parameters comprise a sensor coupled with the work machine, a sensor processing unit, and a vehicle control unit. The sensor may be facing in a forward direction. The sensor may be configured to collect image data of the pile in a field of view of the sensor.

A sensor processing unit may be communicatively coupled with the sensor. The sensor processing unit may be configured to receive the image data from the sensor, wherein the sensor processing unit is configured to calculate a volume estimation of the pile based on the image data.

A vehicle control unit may be communicatively coupled with the sensor processing unit. The vehicle control unit can be configured to modify a loading parameter of the work machine in response to a predictive load of the pile.

The vehicle control unit may have a memory unit and a data processing unit.

The memory unit can associate a material property from a stored database based on either the image data or the operator's input.

The data processing unit, which may be in communication with the memory unit, is configured to calculate the predictive load of the pile based on the volume estimation and the material property.

The sensor may be either a stereoscopic vision device or a laser distance device.

The sensor processing unit may comprise a distance-calculating unit and an image processing unit. The distance-calculating unit may calculate the spatial offset of the pile from the sensor. The image processing unit may be in communication with the sensor and the distance-calculating unit. The image processing unit may calculate the volume estimation of the pile based on the image data and the spatial offset.

A loading parameter can be an engine speed, a transmission ratio, a hydraulic flow rate, a hydraulic pressure, a rimpull ratio, and a valve position.

In one instance, the vehicle control unit may generate an engine speed signal to the engine controller in response to the predictive load of the pile to temporarily increase the engine speed at least prior to or at the instant an attachment engages a pile.

In another instance, the vehicle control unit generates a transmission control signal to the transmission controller in response to the predictive load of the pile to temporarily increase the transmission ratio at least prior to or at the instant the attachment engages the pile.

In another instance, the vehicle control unit generates a hydraulic force signal to the hydraulic cylinder in response to the predictive load of the pile to modify the hydraulic flow rate, the hydraulic pressure, or a valve position.

Furthermore, the engine speed sensor may generate a subsequent engine speed signal after the attachment engages the pile. The vehicle control unit may compare the subsequent engine speed signal to the engine speed signal. The engine control unit may then adjusts future engine speed signals based on a moving average for use a next time the attachment engages the pile.

The sensor processing unit may further comprise an edge detection unit. The edge detection unit can identify discontinuities in either color or pixel intensity of the image data to identify edge where the sensor processing unit calculates a volume estimation based on discontinuities.

The system may further comprise a ground sensor. The ground sensor faces towards the ground to collect image data of a ground surface to determine a material property of the ground surface. The vehicle control unit may modify a loading parameter based on a material property of the ground surface.

These and other features will become apparent from the following detailed description and accompanying drawings, wherein various features are shown and described by way of illustration. The present disclosure is capable of other and different configurations and its several details are capable of modification in various other respects, all without departing from the scope of the present disclosure. Accordingly, the detailed description and accompanying drawings are to be regarded as illustrative in nature and not as restrictive or limiting.

BRIEF DESCRIPTION OF THE DRAWINGS

The detailed description of the drawings refers to the accompanying figures in which.

Like reference numerals are used to indicate like elements throughout the several figures.

DETAILED DESCRIPTION

The embodiments disclosed in the above drawings and the following detailed description are not intended to be exhaustive or to limit the disclosure to these embodiments. Rather, there are several variations and modifications which may be made without departing from the scope of the present disclosure.

Figure 1:
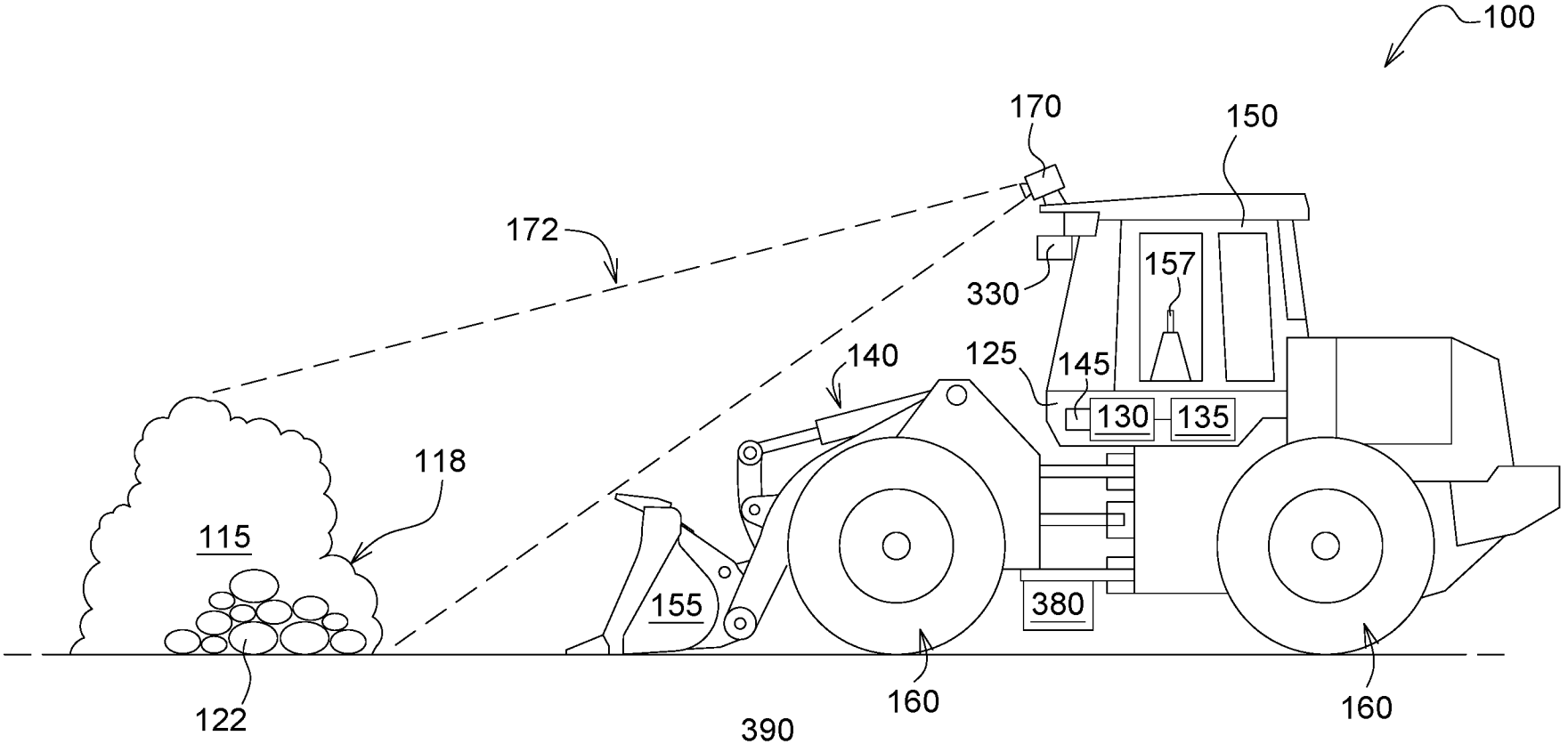
FIG. 1 is an illustration of an exemplary work machine.

In accordance with one embodiment, FIG. 1 illustrates a work machine 100 with a sensor-augmented guidance system 110 approaching a pile 115 of material. Although FIG. 1 discloses a wheel loader, alternative embodiments may include backhoes, skidders, dozers, fellerbunchers, and other forms of construction, forestry, or agricultural machines. The sensor-augmented guidance system 110 (shown in FIG. 2) optimizes the loading parameters 120 of the work machine 100 at the instant and immediately before the work machine 100 engages the pile 115. The work machine 100 comprises a frame 125 configured to support an engine 130, a transmission 135, a hydraulic cylinder 140, an engine speed sensor 470, and an operator station 150. An attachment 155, such as a bucket for digging and loading material is movably coupled to the work machine 100. The work machine 100 comprises an attachment 155 powered and controlled by a lift actuator and a tilt actuator. The lift and tilt actuators which move the attachment 155 are generally hydraulic cylinders 140. However, the lift and tilt actuators could alternatively be another mechanism (not shown) to move the attachment 110. Lift and tilt position sensors 165 coupled to the hydraulic lift and tilt cylinders 140 produce position signals 167 in response to the position of the attachment 155 relative to the work machine 100 by sensing the piston rod extension of the hydraulic lift and tilt hydraulic cylinders 140. The operator station 150 can house an operator and includes operator input devices 157 for controlling the components, including the attachment 155 of the work machine 100.

The work machine 100 may include ground engaging supports 160, such as wheels or a track system (not shown) that support the work machine 100. The engine 130 is configured to drive the transmission 135 that powers the ground engaging supports 160 and the hydraulic cylinders 140 to move the attachment 155.

The pile 115 of material may be any variety of materials that are to be loaded into the attachment 155 and dumped at another location. For example, the pile may include sand, dirt, gravel, quarry rock, and pre-fabricated man-made materials. Alternatively, the pile 115 may be an embankment or hill formed of a tough material, such as clay, embedded rocks, or other tough material. The work machine 100 may encounter any number of variations of material types in a pile 115 to be loaded during its course of operation. It is understood that the reference to a pile 115 encompasses any material to be loaded which may be more than a mere heap of things lying one on top of another.

The work machine 100 comprises a sensor 170 facing in a generally forward direction.

The forward direction may be either parallel to the fore-aft direction of the work machine 100, or in a generally forward direction wherein the sensor may move and face in a direction anywhere in an area forward of the work machine 100. The sensor 170 is configured to collect image data (shown in FIG. 2) of a pile in a field of view 172 (designated by the dotted line) of the sensor 170. The sensor 170 may be, for example, a stereoscopic vision device 230 or a laser distance device 240 (shown in FIGS. 2 and 3A-3C).

Figure 2:
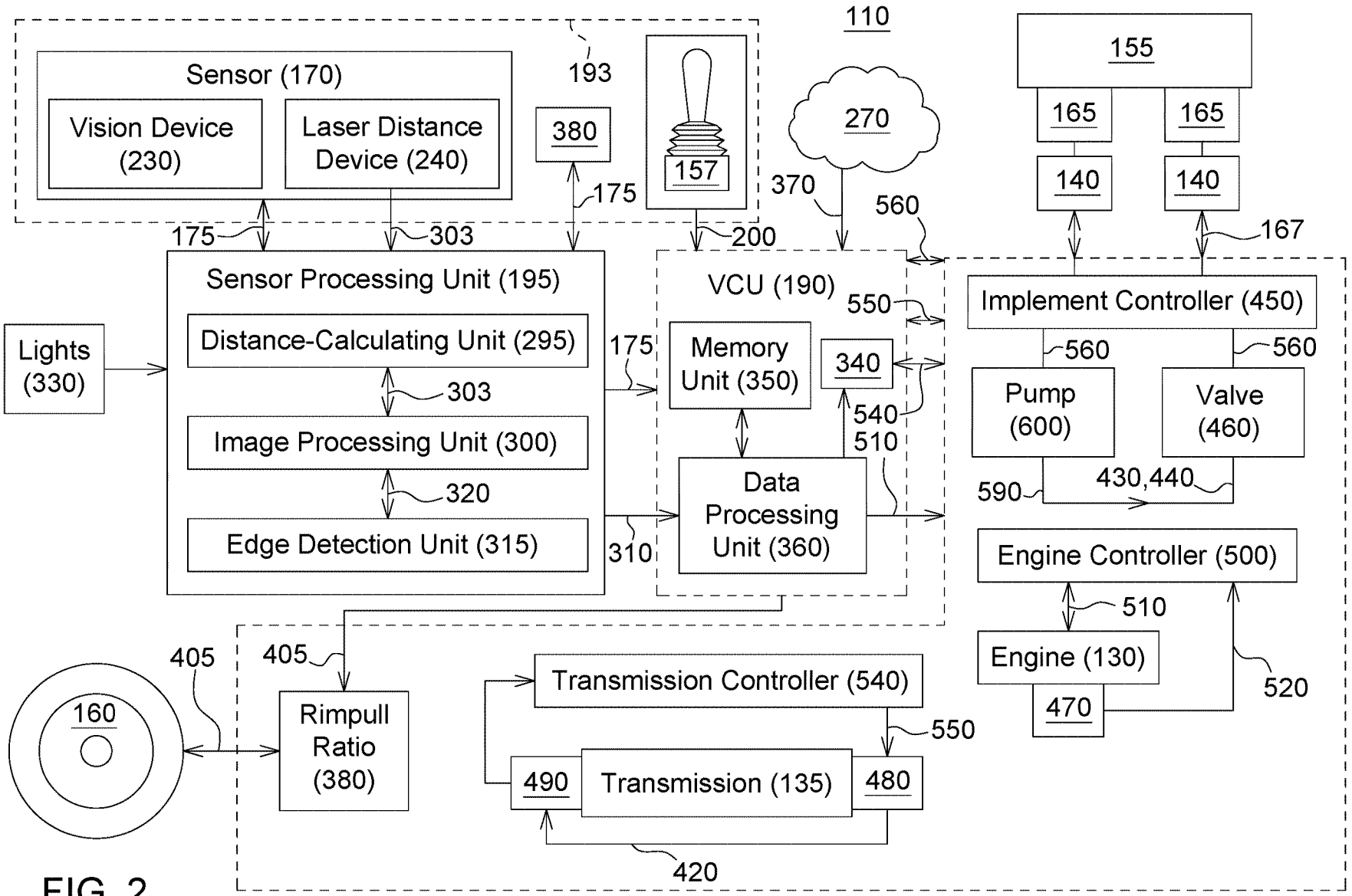
FIG. 2 is a block diagram of a sensor-augmented guidance system for the work machine of FIG. 1.
Figure 3A:
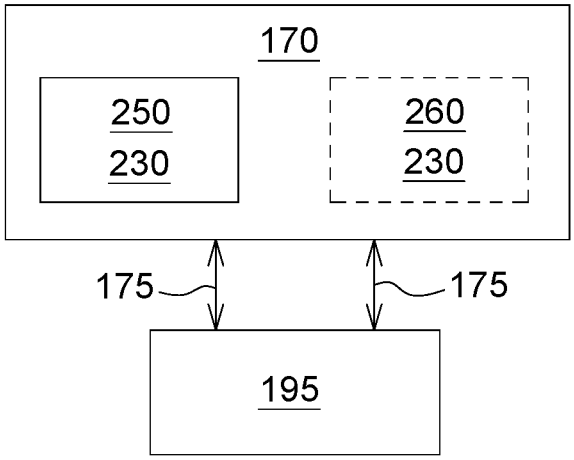
FIG. 3A is an embodiment of a portion of the sensor-augmented guidance system shown in FIG. 2.
Figure 3B:
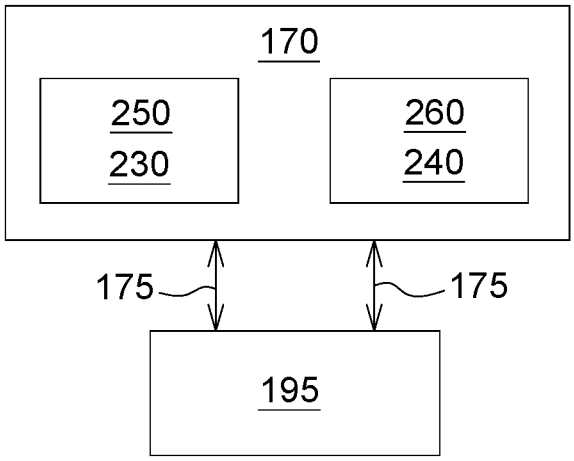
FIG. 3B is an alternative embodiment of the portion of the sensor-augmented guidance system shown in FIG. 3A.
Figure 3C:
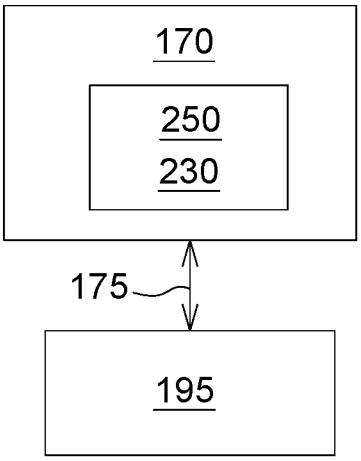
FIG. 3C is another alternative embodiment of the portion of the sensor-augmented guidance system shown in FIG. 3A.

FIG. 2 illustrates a block diagram of a sensor-augmented control system 110 that may be utilized on the work machine 100 for optimizing the loading parameters 120 of a work machine 100. The control system 110 may comprise input elements 193, a sensor processing unit 195 and a vehicle control unit (VCU)190. The input elements 193 comprises a sensor 170 coupled to the work machine 100 wherein the sensor 170 is facing a generally forward direction (as shown in FIG. 1). The term "sensor" collectively refers to either a singular sensor, or a plurality of sensors as described in detail below. The sensor 170 is preferably coupled to or near a top surface of the operator station 150 where the view from the sensor 170 of a pile 115 to be engaged is least obstructed. The sensor 170 is configured to collect image data 175 of a pile 115 in the sensor's field of view 172 (indicated by the dotted lines in FIG. 1). The sensor 170 can comprise the stereoscopic vision device 230, laser distance device 240, or other alternative forms of range imaging. As exemplified in the various embodiments shown in FIGS. 3A-3C, a detailed view of a portion of the sensor-augmented guidance system 110, the sensor 170 comprises a first sensor 250 and an optional second sensor 260, wherein the first sensor 250 and the second sensor 260 are communicatively coupled to the sensor processing unit 195. In the configuration shown in FIG. 3A, the first sensor 250 may comprise a primary stereoscopic vision device 230, while the second sensor 260 may comprise a secondary stereoscopic vision device 230. In the configuration shown in FIG. 3B, the second sensor 260 may be a laser distance device 240. The second sensor 260, in FIGS. 3A and 3B, is optional and provides redundancy to the first sensor 250 in case of failure, malfunction or accuracy improvement of the spatial offset measurements from the sensors 210 to the pile 115, or more specifically the surface 118 of the pile. FIG. 3C shows the alternative embodiment of one sensor comprising a stereoscopic vision device 230. The stereoscopic vision device 230 may provide digital data format output as image data 175 of a series of stereo still frame images at regular or periodic intervals, or at other sampling intervals. Each stereo still frame image (e.g. the first image data or the second image data) has two component images of the same field of view 172 or a portion of the same field of view 172.

As shown in FIG. 1, the field of view 172 of the sensor 170 may be tilted downwards from a generally horizontal plane at a down-tilted angle (e.g. approximately 5 to 30 degrees from the horizontal plane or horizontal axis). This advantageously provides relatively less sky in the field of view of the sensor 170 such that the collected image data 175 tends to have a more uniform image profile. The tilted configuration is also well suited for mitigating the potential dynamic range issues of bright sunlight or intermediate cloud cover, for instance. Additionally, tilting the sensor 170 downwards may reduce the accumulation of dust and other debris on the external surface of the sensor 170. This is especially applicable for the stereoscopic vision device 230 where image data 175 is collected. Furthermore, the tilted configuration of the sensor is angled such that the sensor 170 can be used to ensure the attachment 155 (e.g. the cutting edge of a bucket) always clears the truck sideboards when dumping and when backing away after dumping to prevent any collision between the attachment 100 and the truck (not shown). In one embodiment, the tilted configuration is adapted to include a truck's sideboard edge when the attachment 155 is at a full lift height. While a fixed sensor may be sufficient in a case, where a truck's sideboard, a pile or aggregate of a pile are easy to see and measure under all or most circumstances, a moveable sensor may orient itself or may get oriented by an operator such, that the visibility of the pile in a field of view is optimized.

Figure 4:
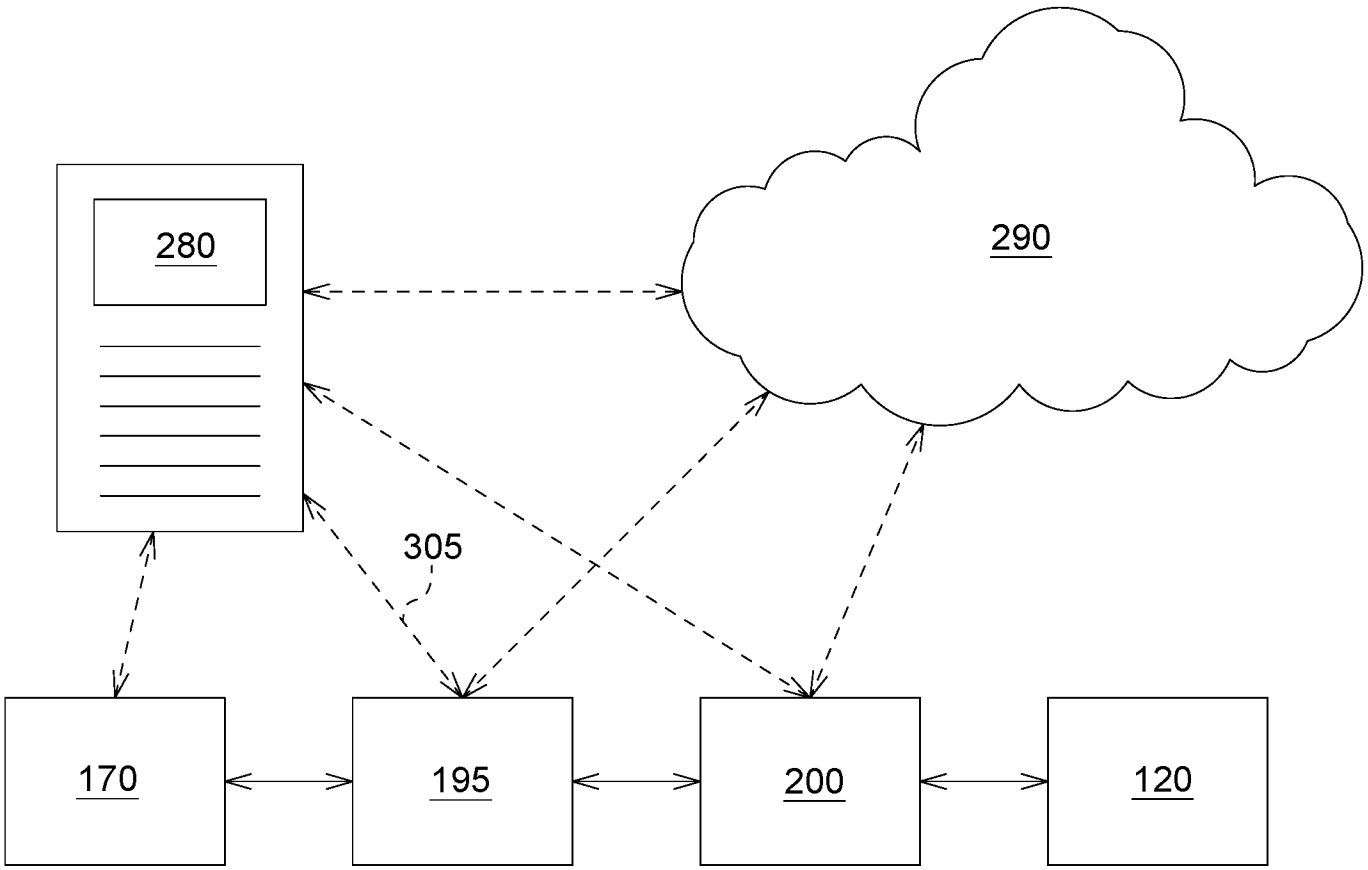
FIG. 4 is a simplified block diagram showing the sensor-augmented guidance system wherein communication may occur wirelessly using other exemplary type devices.

The sensor processing unit 195 is communicatively coupled to the sensor 170. The sensor processing unit 195 is configured to receive the image data 175 from the sensor 170, and calculate a volume estimation 310 of the pile 115 based on the image data 175. As shown in FIG. 4, the sensor processing unit 195 or any other controller or unit as described below, may be located on the work machine 100, on the sensor 170, a mobile device 280, or another location such as a cloud 290 wherein communication occurs through a wireless data communication device 305 (e.g. Bluetooth shown in dotted lines). In some embodiments, a unit can comprise a controller, a microcomputer, a microprocessor, a microcontroller, an application specific integrated circuit, a programmable logic array, a logic device, an arithmetic logic unit, a digital signal processor, or another data processor and supporting electronic hardware and software.

It should be appreciated that the sensor processing unit 195 may correspond to an existing controller of the work machine or may correspond to a separate processing device. For instance, in one embodiment, the machine control module may form all or part of a separate plug-in module that may be installed within the work machine to allow for the disclosed system and method to be implemented without requiring additional software to be uploaded onto existing control devices of the work machine.

Returning to FIG. 2, the sensor processing unit 195 may comprise a distance-calculating unit 295, and an image processing unit 300. In one embodiment, the distance-calculating unit 295 calculates the spatial offset 303 of the pile 115 from the image data 175 from the sensor 170, or more specifically, the spatial offset 303 of the surface of the pile 118 from the sensor 170. The distance-calculating unit 295 applies a stereo matching algorithm or disparity calculator to the collected image data 175. The stereo matching algorithm or disparity calculator determines the disparity for each set of corresponding pixels in the right and the left image and then estimates a distance of the sensor 170 from the surface of the pile 118, or pile aggregate using this measured disparity and the known distance between the right and the left lens of a stereoscopic vision device 230. This calculated spatial offset 303 can optionally be supplemented by a second sensor 260 (e.g. a laser distance device) to confirm or improve the accuracy of the calculated spatial offset 303. In one exemplary embodiment, FIG. 2 shows the sensor 170 comprising a stereoscopic vision device 230 and a laser distance device 240. Alternative embodiments were previously discussed in FIGS. 3A-3C.

The image processing unit 300 is in communication with the sensor 170 and the distance-calculating unit 295. The image processing unit 300 calculates the volume estimation 310 of the pile 115 based on the image data 175 and the spatial offset 303. In one example, the image processing unit 300 can identify a set of two-dimensional or three dimensional points (e.g. Cartesian coordinates or Polar coordinates) in the collected image data 175 that define the pile position, an aggregate 122 of the pile, or both. The set of two-dimensional or three-dimensional points can correspond to pixel positions in images collected by the stereoscopic vision device 230. The image processing unit 300 may rectify the image data 175 to optimize analysis. The image processing unit 300 may use color discrimination, intensity discrimination, or texture discrimination to identify pixels from one or more pile aggregate pixels from the image data 175 and associate them with pixel patterns, pixel attributes (e.g. color or color patterns like Red Green Blue (RGB) pixel values), pixel intensity patterns, texture patterns, luminosity, brightness, hue, or reflectivity to calculate the area of the pile 115 or the surface of the pile 118, and corresponding volume estimation 310 with the calculated or measured spatial offset 303 of the pile 115 or surface of the pile 118 from the sensor 170.

The sensor processing unit 195 may further comprise an edge detection unit 315 communicatively coupled to sensor 170 and/or image processing unit 300. The edge detection unit 315 identifies discontinuities in either pixel color or pixel intensity of the image data 175 to identify edges. The sensor processing unit 195 calculates the volume estimation 310 based on the discontinuities. The edge detection unit 315 may apply an edge detection algorithm to image data. Any number of suitable edge detection algorithms can be used by the edge detection unit 315. Edge detection refers to the process of identifying and locating discontinuities in pixels in an image data 175 or collected image data. For example, the discontinuities may represent material changes in pixel intensity or pixel color which define the boundaries of objects in an image. A gradient technique of edge detection may be implemented by filtering image data to return different pixel values in first regions of greater discontinuities or gradients than in second regions with lesser discontinuities or gradients. For example, the gradient technique detects the edges of an object by estimating the maximum and the minimum of the first derivative of the pixel intensity of the image data. The Laplacian technique detects the edges of an object in an image by searching for zero crossings in the second derivative of the pixel intensity image. Further examples of suitable edge detection algorithms include, but are not limited to, Roberts, Sobel, and Canny, as are known to those of ordinary skill in the art. The edge detection unit 315 may provide a numerical output, signal output, or symbol indicative, of the strength or reliability of the edges in field. For example, the edge detection unit 315 may provide a numerical value or edge strength indicator within a range or scale or relative strength or reliability to the linear Hough transformer.

The linear Hough transformer receives edge data (e.g. an edge strength indicator) related to the pile 115 and its aggregate material, and identifies the estimated angle and offset of the strong line segments, curved segments or generally linear edges of the pile 115 in the image data 175. The linear Hough transformer comprises a feature extractor for identifying line segments of objects with certain shapes from the image data 175. For example, the linear Hough transformer identifies the line equation parameters or ellipse equation parameters of objects in the image data from the edge data 320 outputted by the edge detection unit 315 or Hough transformer classifies the edge data 320 as a line segment, an ellipse, or a circle. Thus it is possible to detect the sub-components of an aggregate pile of stones, sand, dirt, rocks, or man-made materials such as pipes, each of which may have generally linear, rectangular, elliptical or circular features. Alternatively, the edge detection unit 315 may simply identify an estimated outline of the pile 115, thereby calculating its area.

In one embodiment, the sensor processing unit 195 may be coupled, directly or indirectly, to optional lights 330 (shown in FIGS. 1 and 2) on the work machine 100 for illumination of the pile 115. For example, the sensor processing unit 195 may control drivers, relays, or switches, which in turn control the activation of deactivation of optional lights 330 on the pile 115. In one example, the sensor processing unit 195 may activate the lights 330 directed toward the field of view 172 of the stereoscopic vision device 230 if an optical sensor or light meter (not shown) indicates that ambient light level is below a certain minimum threshold.

With continued reference to FIG. 2, the vehicle control unit 190 on the work machine 100 is communicatively coupled with the sensor processing unit 195. The vehicle control unit 190 is configured to modify a loading parameter 120 of the work machine 100 in response to a predictive load 340 of the pile. The vehicle control unit 190 comprises a memory unit 350, and a data processing unit 360.

The memory unit 350 associates a material property of the pile from a stored database 270 having material property reference data 370 based on either the image data 175, operator input signal 200 from the operator input device 157, or both. The stored database 270 may comprise an electronic memory, a magnetic disc drive, an optical disc drive or a magnetic storage device or an optical storage device, either on the work machine 100 or another location (e.g. data cloud 290 or a mobile device 280 shown in FIG. 4), in communication with the vehicle control unit 190. In one example similar to the image processing unit 300, the memory unit 350 can identify a set of two-dimensional or three dimensional points (e.g. Cartesian coordinates or Polar coordinates) in the collected image data 175 that define the pile position, an aggregate of the pile, or both. The set of two-dimensional or three-dimensional points can correspond to pixel positions in images collected by the stereoscopic vision device 230. The memory unit 350 may identify, use or retrieve material property reference data 370. In one exemplary embodiment, the memory unit 350 may pre-populate a list of suggested material property reference data 370 of the pile based on the image data 175 on an interactive screen (e.g. within the operator station or a mobile device connected to a cloud or the vehicle control unit 190) wherein the operator manually selects from the list. In another embodiment, the memory unit 350 automatically identifies and associates material property reference data 370 based on the image data 175 (e.g. the two-dimensional or three-dimensional points and color spectrum of the pile). The memory unit 350 may use color discrimination, intensity discrimination, or texture discrimination to identify pixels from one or more pile aggregate pixels from the image data and associate them with pixel patterns, pixel attributes (e.g. color or color patterns like Red Green Blue (RGB) pixel values), pixel intensity patterns, texture patterns, luminosity, brightness, hue, or reflectivity from the stored database and assign the appropriate material property reference data 370 (also referred to as material property throughout) for identifying material properties, and calculating the predictive load 340. Material property 370 may include, but is not limited to, size, type, density, porosity, surface texture, surface friction, weight, specific heat, moisture, and geometry.

The data processing unit 360 is communicatively coupled with the memory unit 350. The data processing unit 360 is configured to calculate the predictive load 340 of the pile based on the volume estimation 310 and the material property 370. Predictive load 340 is the anticipated load to be placed on any one or more of the loading parameters 120.

In another embodiment, the system 110 may further comprise a ground sensor 380 (shown in FIGS. 1 and 2) facing towards the ground 390, or ground surface. The ground sensor 380 may collect image data 175 of a ground surface to determine a material property 370 of the ground surface wherein the vehicle control unit 190 (discussed below) modifies a loading parameter 120 based on the material property 370 of the ground surface 390. The material properties of a ground surface 390 may be different from a pile 115, thereby affecting loading parameters 120 of the work machine 100 such as the rimpull ratio 400 which in turn effects the load on the work machine 100. Rimpull ratio 400 is defined as the tangential shear force exerted by the driving surface of the machine 100 (i.e. ground engaging supports 160) on the ground surface 390. The ground sensor 380 is preferably located at or in proximity to the ground engaging supports 160 to advantageously improve the rimpull ratio 400. In one embodiment, the ground sensor 380 may be located closer to the aft position near the rear ground engaging supports 160. Alternatively, in another embodiment, the ground sensor 380 may be located closer to the front portion of the work machine 100, near the front ground engaging supports 160. In other possible embodiments, there may be a plurality of ground sensors 380 located in the front and back, or around the periphery of the work machine 100. In the embodiment shown in FIG. 1, the ground sensor 380 is preferably a stereoscopic vision device capable of acquiring image data 175. However, in alternative embodiments, the ground sensor 380 may comprise of any sensor 170 capable of identifying a material property 370 of the ground (e.g. moisture sensor, lidar, radar, vision device, etc.). Input from either the sensor 170 and/or the ground sensor 380 may modify a loading parameter 120 of the work machine 100 in response to a predictive load 340 of the pile wherein a rimpull signal 405 in response to the predictive load 340 is communicated from the vehicle control unit 190.

The loading parameters 120 comprise engine speed 410, a transmission ratio 420, a hydraulic flow rate 430, a hydraulic pressure 440, a rimpull ratio 400, and a valve position 460.

An engine speed sensor 470 may be disposed in the control system 110 for detecting an engine speed 410 of the engine 130. Moreover, a transmission input speed sensor 480 may detect an input speed of the transmission 135, and a transmission output speed sensor 490 may detect an output speed of the transmission 135. The engine speed sensor 470, transmission input speed sensor 480, and the transmission output speed sensor 490 can be communicatively coupled to the vehicle control unit 190.

The vehicle control unit 190 can be communicatively coupled with the engine controller 500. The vehicle control unit 190 may generate an engine speed signal 510 in response to the predictive load 340 of the pile to temporarily increase the engine speed either prior to or at the instant of the attachment 155 engaging a pile 115. This advantageously provides sufficient force for the work machine 100 when engaging the pile 115 to prevent the engine from stalling if overloaded. At the same time, it would minimize fuel consumption waste, tire wear, and operator efficiency variation. With continued reference to FIG. 2, the engine speed sensor 470 may generate a subsequent engine speed signal 520 after the attachment engages the pile 115. The vehicle control unit 190 may then compare the subsequent engine speed signal 520 to the engine speed signal 510 and adjusts future engine speed signals based on a moving average for use a next time the attachment engages the pile. This feedback mechanism corrects the loading parameters 120 of the work machine 100 in instances where the weight determination from the data processing unit 360 may be inaccurate. For example, moisture content and bulk density of the material, which may not be measurable with image data 175, may vary such that the total weight or load is different for the same volume. The feedback mechanism refines the loading parameters 120 with each engagement with the pile during an occasion of operating the work machine 100. These settings may then be stored in memory on the vehicle control unit 190, or alternatively reset upon starting the work machine 100. Alternatively, this may be referred to as a feedback mechanism correlating the predictive load 340 with an onboard weighing system of the work machine 100.

The vehicle control unit 190 can be further communicatively coupled with the transmission controller 540. The vehicle control unit 190 may generate a transmission control signal 550 in response to the predictive load 340 of the pile to lower the transmission ratio 420 either prior to or at the instant the attachment engages a pile 115. Similar to the subsequent engine speed signal 520, the vehicle control unit 190 may adjust the transmission control signal 550 after engaging the pile 115 for use a next time the attachment engages the pile.

The vehicle control unit 190 may be further communicatively coupled with the implement controller 450 which controls one or more hydraulic cylinders 140. The vehicle control unit may generate a hydraulic force signal 560 in response to the predictive load 340 of the pile to modify one or more of a hydraulic flow rate 430, a hydraulic pressure 440, and a position of a control valve 460. The hydraulic force signal 560 augments the operator's input command signal 200 in response to the predictive load 340 to move the attachment 155. The hydraulic force signal 560 mechanically, hydraulically, and/or electrically, to the hydraulic control valve 460. The hydraulic control valve 460 receives pressurized hydraulic fluid 590 from a hydraulic pump 600, and selectively sends such pressurized hydraulic fluid 590 to one or more of hydraulic cylinders 140 based on the augmented hydraulic force signal 560. The hydraulic cylinders 140 are extended or retracted by the pressurized fluid and thereby actuate the attachment 155.

Figure 5:
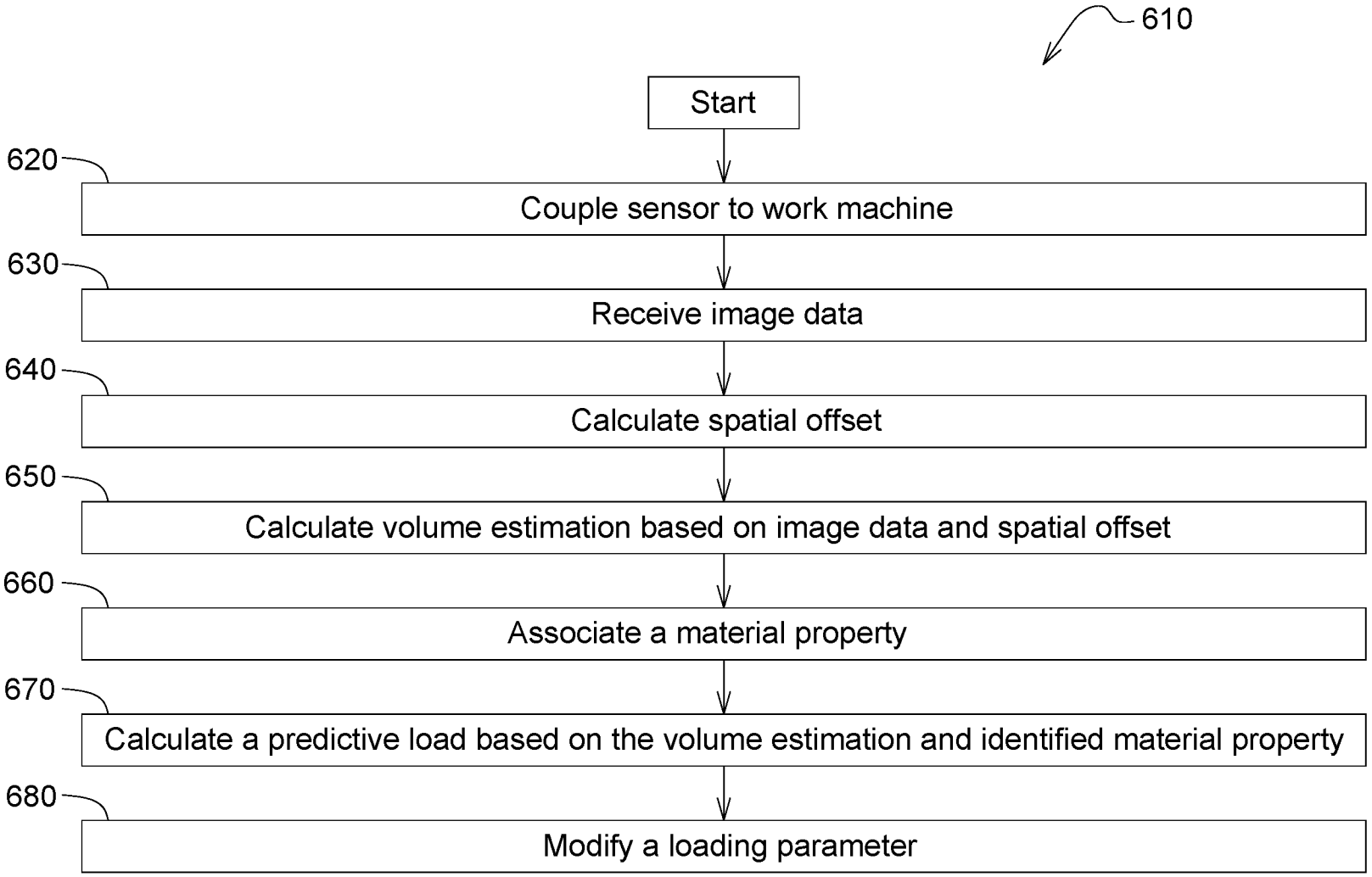
FIG. 5 is a flow chart of a method executed by the control system of FIG. 2 for optimizing the loading parameters of a work machine of FIG. 1, in accordance with an embodiment of the present disclosure.

Referring to FIG. 5, with continued reference to FIGS. 1 and 2, a method for optimizing the loading parameters 610 of a work machine 100, is shown. In a first block 620 of the method, the sensor 170 is coupled to a work machine 100 and the sensor 170 is configured to collect image data 175 of the pile 115 in a field of view 172 of the sensor 170. The sensor 170 may be located on a surface of the operator's station 150 where the field of view 172 of the sensor 170 is generally unobstructed. In the second block 630 the sensor processing unit 195 receives the image data 175 from the sensor 170. In a third block 640, the distance-calculating unit 295 located on the sensor processing unit 195 calculates a spatial offset 303 of the pile 115, or a surface of the pile 118 from the image data 175 provided by the sensor 170. In a fourth block 650, the image processing unit 300 located on the sensor processing unit 195 calculates a volume estimation 310 based on the image data 175 and/or the spatial offset 303 provided by the sensor 170 and the distance-calculating unit 295 located on the sensor processing unit 195. In a fifth block 660, the memory unit 350 located on the vehicle control unit 190 of the work machine 100 associates a material property 370 of the pile 115 from a stored database 270 located in a cloud or on the vehicle control unit based on the image data 175, an operator input 200, or both. In a sixth block 670, the data processing unit 360 located on the vehicle control unit 190 calculates a predictive load 340 of the pile based on the volume estimation 310 and the identified material property 370. In a seventh block 680, the vehicle control unit 190 modifies a loading parameter 120 of the work machine based on the predictive load 340 of the pile. The loading parameters 120 comprises engine speed 410, a transmission ratio 420, a hydraulic flow rate 430, a hydraulic pressure 440, a rimpull ratio 400, and a valve position 460.

The terminology used herein is for the purpose of describing particular embodiments or implementations and is not intended to be limiting of the disclosure. As used herein, the singular forms "a", "an" and "the" are intended to include the plural forms as well, unless the context clearly indicates otherwise. It will be further understood that the any use of the terms "has," "have," "having," "include," "includes," "including," "comprise," "comprises," "comprising," or the like, in this specification, identifies the presence of stated features, integers, steps, operations, elements, and/or components, but does not preclude the presence or addition of one or more other features, integers, steps, operations, elements, components, and/or groups thereof.

The references "A" and "B" used with reference numerals herein are merely for clarification when describing multiple implementations of an apparatus.

One or more of the steps or operations in any of the methods, processes, or systems discussed herein may be omitted, repeated, or re-ordered and are within the scope of the present disclosure.

While the above describes example embodiments of the present disclosure, these descriptions should not be viewed in a restrictive or limiting sense. Rather, there are several variations and modifications which may be made without departing from the scope of the appended claims.

What is claimed is:

1. A sensor-augmented guidance system for optimizing a loading parameter of a work machine, the work machine extending in a fore-aft direction, the work machine having an engine, a transmission, a hydraulic cylinder, an engine speed sensor, and an attachment movably coupled to the work machine to engage a pile, the system comprising:

a sensor coupled with the work machine, the sensor facing in a forward direction, the sensor configured to collect image data of the pile in a field of view of the sensor;

a sensor processing unit communicatively coupled with the sensor, the sensor processing unit configured to receive the image data from the sensor, wherein the sensor processing unit is configured to calculate a volume estimation of a portion of the pile to engage with the attachment based on the image data; and a vehicle control unit communicatively coupled with the sensor processing unit, the vehicle control unit configured to modify the loading parameter of the work machine in response to a predictive load of the pile, the vehicle control unit having:

a memory unit, the memory unit associating a material property of the pile from a stored database based on the image data and an operator input wherein the memory unit pre-populates a list of suggested material property reference data of the pile based on the image data and the operator manually selects from the list, wherein the memory unit uses one or more of color discrimination, intensity discrimination, and texture discrimination to identify pixels from one or more pile aggregate pixels from the image data, the material property reference data including two or more of size, type, density, porosity, surface texture, surface friction, weight, specific heat, moisture, and geometry, and a data processing unit in communication with the memory unit, the data processing unit configured to calculate the predictive load of the pile at engagement based on the volume estimation and the material property of the portion of the pile to engage with the attachment.

2. The system of claim 1, wherein the sensor is one or more of a stereoscopic vision device and a laser scanning device.

3. The system of claim 1, wherein the sensor processing unit comprises:

a distance-calculating unit, the distance-calculating unit calculating a spatial offset of the pile from the sensor; and an image processing unit in communication with the sensor and the distance-calculating unit, the image processing unit calculating the volume estimation of the pile based on the image data and the spatial offset.

4. The system of claim 1, wherein the loading parameter comprises one or more of an engine speed, a transmission ratio, a hydraulic flow rate, a hydraulic pressure, a rimpull ratio, and a valve position.

5. The system of claim 4, wherein the vehicle control unit is further communicatively coupled with an engine controller, the vehicle control unit generating an engine speed signal in response to the predictive load of the pile to temporarily increase the engine speed one or more of prior to and at an instant of the attachment engaging the pile.

6. The system of claim 4, wherein the vehicle control unit is further communicatively coupled with a transmission controller, the vehicle control unit generating a transmission control signal in response to the predictive load of the pile to lower a transmission ratio one or more of prior to and at an instant of the attachment engaging the pile.

7. The system of claim 4, wherein the vehicle control unit is further communicatively coupled with the hydraulic cylinder, the vehicle control unit generating a hydraulic force signal in response to the predictive load of the pile to modify one or more of the hydraulic flow rate, the hydraulic pressure, and the valve position wherein the hydraulic signal augments the operator's input command signal to move the attachment.

8. The system of claim 5 further comprising a feedback mechanism, wherein the feedback mechanism comprises engine speed sensor generating a subsequent engine speed signal after the attachment engages the pile, the vehicle control unit comparing the subsequent engine speed signal to the engine speed signal, the vehicle control unit adjusting future engine speed signals based on a moving average for use a next time the attachment engages the pile.

9. The system of claim 3, wherein the sensor processing unit further comprises an edge detection unit, the edge detection unit identifying discontinuities in one or more of pixel color and pixel intensity of the image data to identify edges, the sensor processing unit calculating the volume estimation based on the discontinuities.

10. The system of claim 1 further comprising a ground sensor, the ground sensor facing toward a ground surface to collect image data of the ground surface to determine a material property of the ground surface, wherein the vehicle control unit modifies the loading parameter based on the material property of the ground surface when the material property of the ground surface is different from the pile.

11. A method of optimizing a loading parameter of a work machine having a sensor-augmented guidance system, the work machine extending in a fore-aft direction, the work machine having an engine, a transmission, a hydraulic cylinder, and an attachment movably coupled to the work machine to engage a pile, the method comprising:

collecting image data of the pile in a field of view of a sensor;

receiving the image data from the sensor by a sensor processing unit;

retrieving a material property reference data from a stored database by a memory unit;

pre-populating a list of suggested material property reference data of the pile by the memory unit based on the image data, wherein the memory unit uses one or more of color discrimination, intensity discrimination, and texture discrimination to identify pixels from one or more pile aggregate pixels from the image data, the material property reference data including two or more of size, type, density, porosity, surface texture, surface friction, weight, specific heat, moisture, and geometry;

selecting the material property reference data by the operator from the list;

calculating a spatial offset of the pile from the sensor by a distance-calculating unit located on the sensor processing unit;

calculating a volume estimation by an image processing unit located on the sensor processing unit of a portion of the pile to engage with the attachment based on the image data and the spatial offset;

calculating a predictive load of the pile at engagement by a vehicle control unit based on the volume estimation and the material property reference data of the portion of the pile to engage with the attachment; and modifying the loading parameter of the work machine by a vehicle control unit based on the predictive load, wherein the loading parameter comprises one or more of an engine speed, a transmission ration, a hydraulic flow rate, a hydraulic pressure, a rimpull ratio, and a valve position.

* * * * *